US009492700B1

(12) United States Patent
Wu

(10) Patent No.: US 9,492,700 B1
(45) Date of Patent: Nov. 15, 2016

(54) RESISTANCE ADJUSTING APPARATUS

(71) Applicant: Mu-Chuan Wu, Tainan (TW)

(72) Inventor: Mu-Chuan Wu, Tainan (TW)

( * ) Notice: Subject to any disclaimer, the term of this patent is extended or adjusted under 35 U.S.C. 154(b) by 0 days.

(21) Appl. No.: 14/816,492

(22) Filed: Aug. 3, 2015

(51) Int. Cl.
*A63B 21/00* (2006.01)
*A63B 21/015* (2006.01)

(52) U.S. Cl.
CPC ..... *A63B 21/015* (2013.01)

(58) Field of Classification Search
CPC ..... A63B 21/00
See application file for complete search history.

(56) References Cited

U.S. PATENT DOCUMENTS 4,364,557 A * 12/1982 Serati ..... A63B 71/06 482/65
7,470,220 B2 * 12/2008 Hernandez ..... A63B 21/012 188/25
8,834,324 B2 * 9/2014 Lull ..... A63B 21/015 482/15
2010/0323850 A1 * 12/2010 Bingham, Jr. ..... A63B 21/225 482/63
2013/0203563 A1 * 8/2013 Chen ..... A63B 22/0605 482/63

* cited by examiner

*Primary Examiner* — Jerome w Donnelly
(74) *Attorney, Agent, or Firm* — Harness, Dickey & Pierce, P.L.C.

(57) ABSTRACT

A resistance adjusting apparatus includes a seat having a first shaft, a resistance supplier, and an adjusting assembly. The resistance supplier is mounted in the seat and has a second shaft. The adjusting assembly is mounted on the seat and has a tube, a regulating rod, and a pressing block. The regulating rod is moveably mounted through the tube. The pressing block is mounted on a bottom end of the regulating rod, is connected to the seat, and is located between the first shaft and the second shaft. Therefore, a displacement of the resistance supplier is longer than a displacement of the pressing block, and the sensitivity of the resistance adjustment is increased.

6 Claims, 5 Drawing Sheets

RESISTANCE ADJUSTING APPARATUS

FIELD

The present invention relates to a resistance adjusting apparatus, and more particularly to a resistance adjusting apparatus applied to fitness equipments.

BACKGROUND

This section provides background information related to the present disclosure which is not necessarily prior art.

A conventional resistance adjusting apparatus is mounted on a fitness equipment such as an exercise bike and supplies a proper resistance to the fitness equipment according to a user's need. The conventional resistance adjusting apparatus has a seat and an adjusting assembly. The seat is pivotally mounted on a frame of the exercise bike and has two side plates. The adjusting assembly is mounted on the seat, is connected to the frame, and has a tube, a regulating rod, a spring, and a resistance supplier. The tube is hollow and has an outside surface connected to the frame. The regulating rod is mounted through the tube and can be moved upward or downward relative to the tube. The regulating rod has a head, a body, and a barrier. The body is mounted on a bottom surface of the head and extends through the tube. The barrier is mounted on the body and is located in the tube. The spring is mounted around the body and has two ends respectively connected to the tube and the barrier. The resistance supplier is mounted on a bottom end of the regulating rod and is locked between the two side plates of the seat.

If users want to increase a resistance of the exercise bike, the regulating rod is rotated by the users to move downward, and the resistance supplier is moved downward with the regulating rod to contact a flywheel of the exercise bike, and this can increase the resistance of the exercise bike. If users want to decrease the resistance of the exercise bike, the regulating rod is rotated by the users to move upward, and the resistance supplier is moved upward with the regulating rod, and this can decrease the resistance of the exercise bike.

However, the resistance supplier is directly mounted on the bottom end of the regulating rod and is securely fixed on the seat. In the operation of changing the resistance supplier, the side plates of the seat need to be detached first, and then the resistance supplier can be detached from the body of the regulating rod. Therefore, the change operation of the resistance supplier is complicated.

To overcome the shortcomings, the present invention provides a resistance adjusting apparatus to obviate the aforementioned problems.

SUMMARY

This section provides a general summary of the disclosure, and is not a comprehensive disclosure of its full scope or all of its features.

An aspect of the invention is to provide a resistance adjusting apparatus to simplify the change operation of the resistance supplier.

The resistance adjusting apparatus has a seat, a resistance supplier and an adjusting assembly. The seat has two side plates mounted in the seat at an interval and a first shaft mounted between the two side plates. The resistance supplier is mounted in the seat between the two side plates and has a resistance element and a second shaft. The resistance element is located between the two side plates and is opposite to the first shaft. The second shaft is mounted on the seat, is inserted through the resistance element, and has two ends respectively connected to the two side plates. The adjusting assembly is mounted on the seat and has a tube, a regulating rod, and a pressing block. The tube is hollow above the seat. The regulating rod is moveably mounted through the tube. The pressing block is mounted on a bottom end of the regulating rod, is connected to the side plates, is located between the first shaft of the seat and the second shaft of the resistance supplier, and has a front end of the pressing block extending above a rear end of the resistance element.

The resistance adjusting apparatus is mounted on a frame of a fitness equipment such as an exercise bike. The seat is pivotally connected on the frame via the first shaft. The tube of the adjusting assembly is securely connected to the frame of the fitness equipment. The regulating rod is rotated by the users for driving the pressing block to move upward or downward, and then the seat is pivoted and the resistance supplier is moved by the seat. The pressing block is located between the first shaft and the second shaft of the resistance supplier. A distance between the first shaft and the second shaft is longer than a distance between the first shaft and the pressing block. When the regulating rod is moved upward or downward, the seat driven by the regulating rod is pivoted upon the first shaft, and the displacement of the resistance supplier is longer than a displacement of the pressing block. The sensitivity of the resistance adjustment is increased. In addition, the resistance supplier is mounted in the seat close to a front end of the seat. The second shaft is detached from the seat by the users, and then the resistance element can be changed without disassembling the seat. Thus, the change operation of the resistance supplier is convenient and the change time of the resistance supplier is reduced.

Other aspects, advantages and novel features of the invention will become more apparent from the following detailed description when taken in conjunction with the accompanying drawings.

DRAWINGS

The drawings described herein are for illustrative purposes only of a selected embodiment and not all possible implementations, and are not intended to limit the scope of the present disclosure.

DETAILED DESCRIPTION

Figure 1:
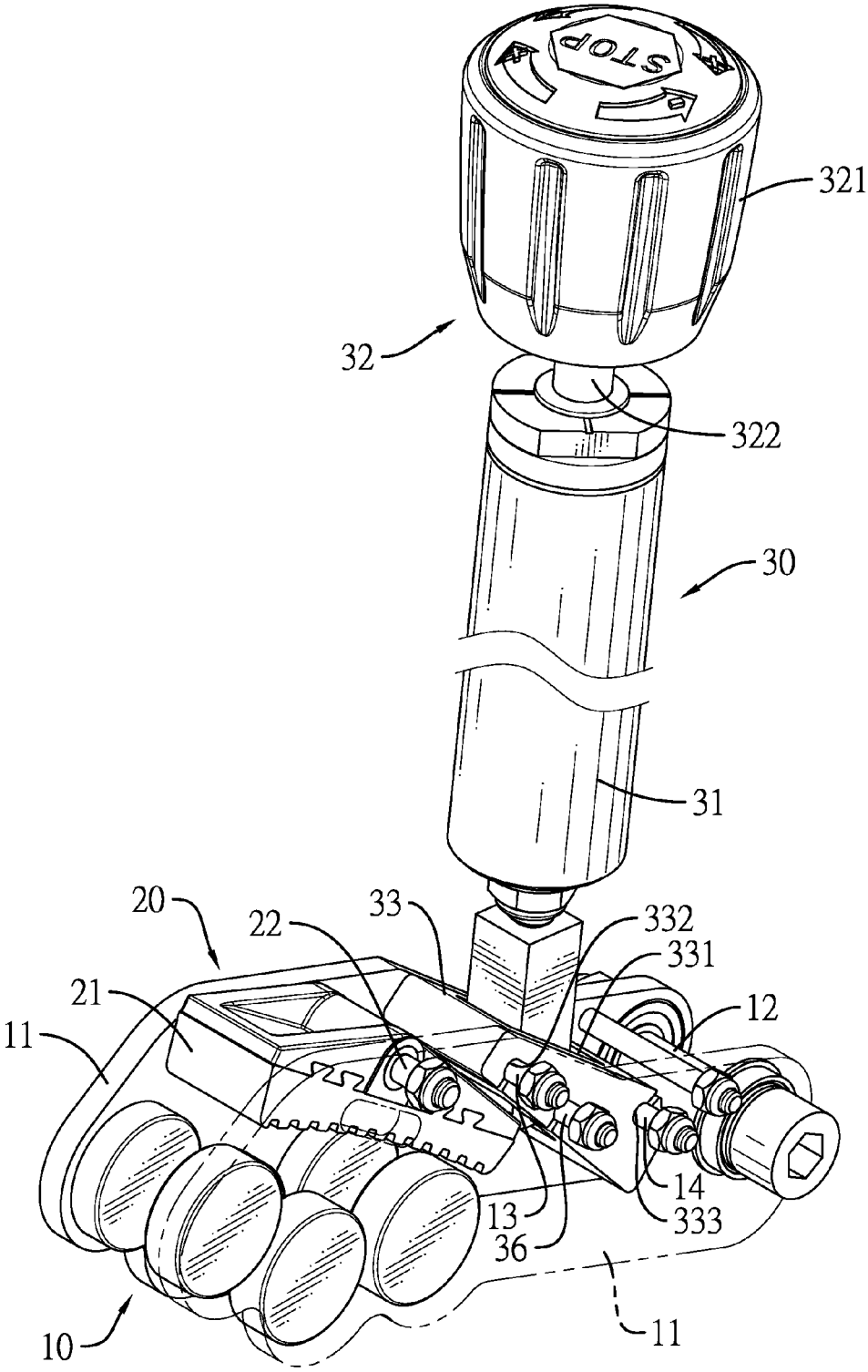
FIG. 1 is a perspective view of a resistance adjusting apparatus in accordance with the present invention.

An example embodiment will now be described more fully with reference to the accompanying drawings With reference to FIGS. 1 and 2, a resistance adjusting apparatus in accordance with the present invention is mounted on a frame 40 of an exercise bike and comprises a seat 10, a resistance supplier 20, and an adjusting assembly 30.

The seat 10 is pivotally connected to the frame 40 and has two side plates 11 and a first shaft 12. The side plates 11 are mounted in the seat 10 and spaced apart at an interval. The first shaft 12 is mounted between the two side plates 11 adjacent to a rear end of the seat 10 and is connected to the frame 40.

The resistance supplier 20 is mounted in the seat 10 between the two side plates 11 and has a resistance element 21 and a second shaft 22. The resistance element 21 is located between the two side plates 11 and is opposite to the first shaft 12. The second shaft 22 is mounted on the seat 10, is inserted through the resistance element 21, and has two ends respectively connected to the two side plates 11.

Figure 4:
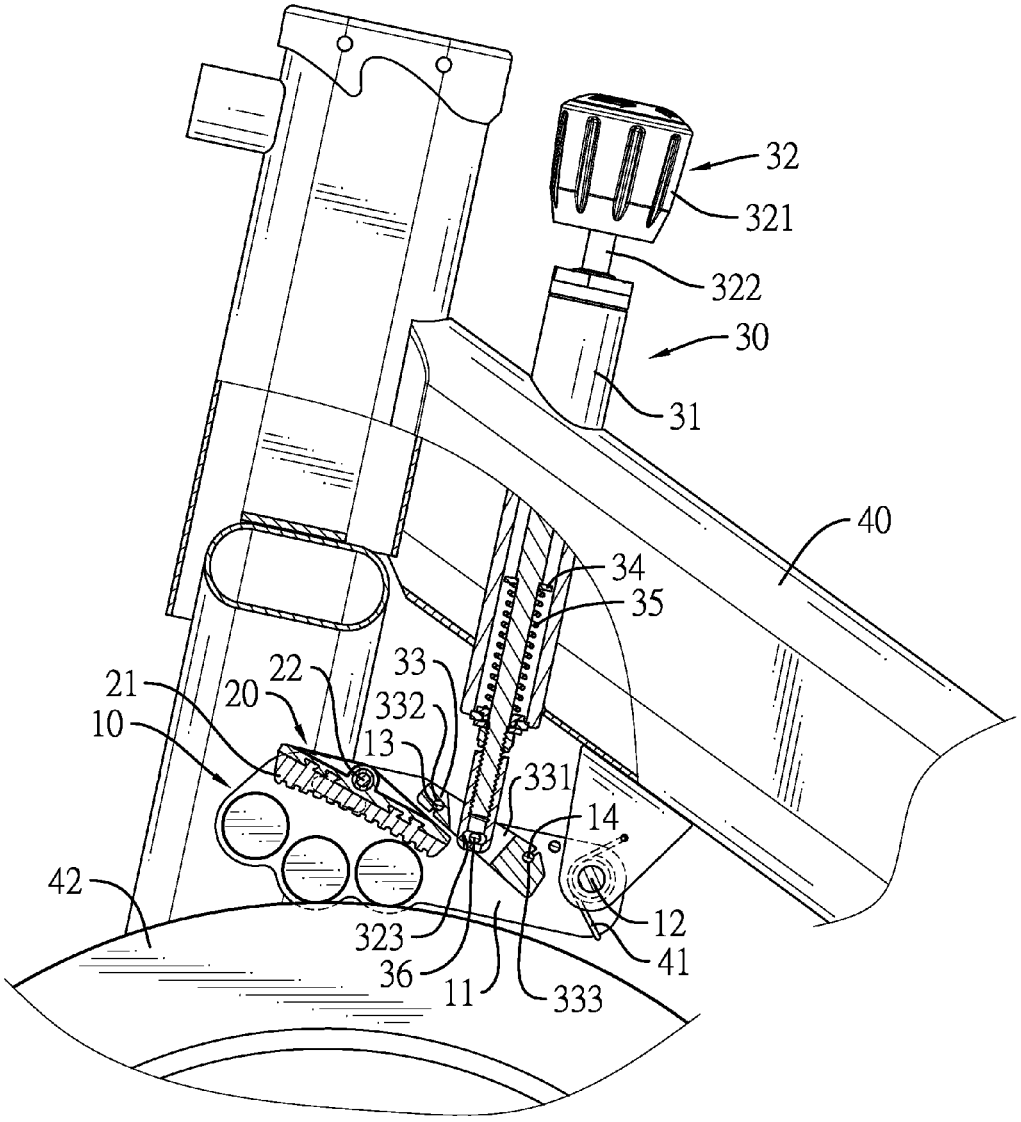
FIG. 4 is a side view in partial section of the resistance adjusting apparatus in FIG. 1, mounted on the frame of the exercise bike.

With reference to FIG. 4, the adjusting assembly 30 is mounted on the seat 10 and has a tube 31, a regulating rod 32, and a pressing block 33. The tube 31 is hollow and is securely connected to the frame 40 of the exercise bike above the seat 10. The regulating rod 32 is moveably mounted through the tube 31. The pressing block 33 is mounted on a bottom end of the regulating rod 32, is connected to the side plates 11, and is located between the first shaft 12 of the seat 10 and the second shaft 22 of the resistance supplier 20. The pressing block 33 has a front end extending above a rear end of the resistance element 21.

With reference to FIG. 4, the regulating rod 32 has a body 322 and a head 321. The body 322 is mounted in and extends out of the tube 31, and the pressing block 33 is mounted on a bottom end of the body 322. The head 321 is mounted on a top end of the body 322 above the tube 31. In addition, the adjusting assembly 30 further has a barrier 34 and a compression spring 35. The barrier 34 is securely mounted around the body 322 and is located in the tube 31. The compression spring 35 is mounted around the body 322 and two ends of the compression spring 35 respectively abut the barrier 34 and the bottom end of the tube 31.

With reference to FIG. 4, the pressing block 33 has a top face, a bottom face, a side face, a recess 331, and a through hole. The recess 331 is formed through the top face and the bottom face of the pressing block 33. The through hole is formed through the side face of the pressing block 33 and communicates with the recess 331. The body 322 has an elongated hole 323. The elongated hole 323 is formed through the bottom end of the body 322. The adjusting assembly 30 further has a stick 36. The stick 36 is mounted in the seat 10 and is inserted through the through hole of the pressing block 33, the elongated hole 323, and the recess 331. The stick 36 has two ends respectively connected to the two side plates 11 of the seat 10.

The pressing block 33 has a first positioning hole 332 and a second positioning hole 333. The first positioning hole 332 is formed in the bottom face of the pressing block 33 adjacent to the front end of the pressing block 33. The second positioning hole 333 is formed in the top face of the pressing block 33 adjacent to a rear end of the pressing block 33. The seat 10 has a first positioning rod 13 and a second positioning rod 14. The first positioning rod 13 is mounted between the two side plates 11 of the seat 10 and is inserted through the first positioning hole 332 of the pressing block 33. The second positioning rod 14 is mounted between the two side plates 11 of the seat 10 and is inserted through the second positioning hole 333 of the pressing block 33.

Figure 2:
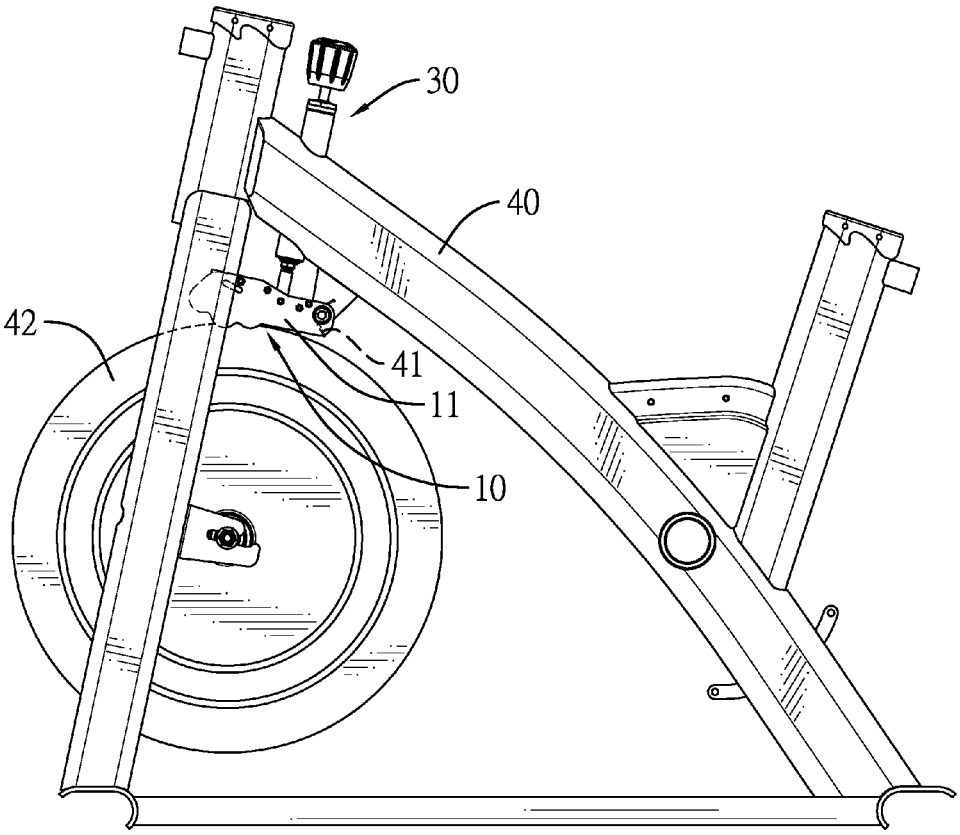
FIG. 2 is an operational side view of the resistance adjusting apparatus in FIG. 1, mounted on a frame of an exercise bike.
Figure 3:
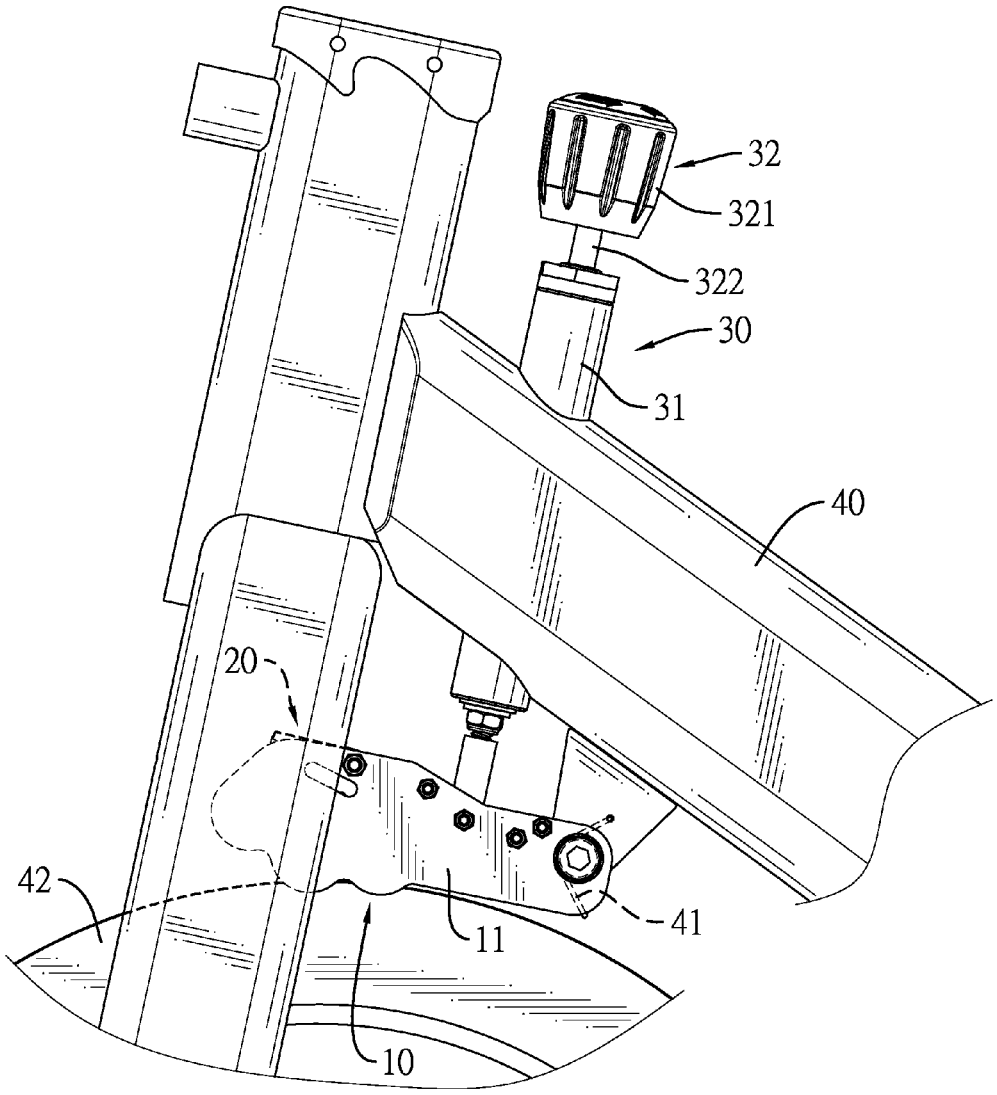
FIG. 3 is an enlarged side view of the resistance adjusting apparatus in FIG. 1, mounted on the frame of the exercise bike.

With reference to FIGS. 2 to 4, a torsion spring 41 is mounted around the first shaft 12. The tube 31 of the adjusting assembly 30 is fixedly mounted on the frame 40. The resistance supplier 20 is above a flywheel 42 of the exercise bike.

Figure 5:
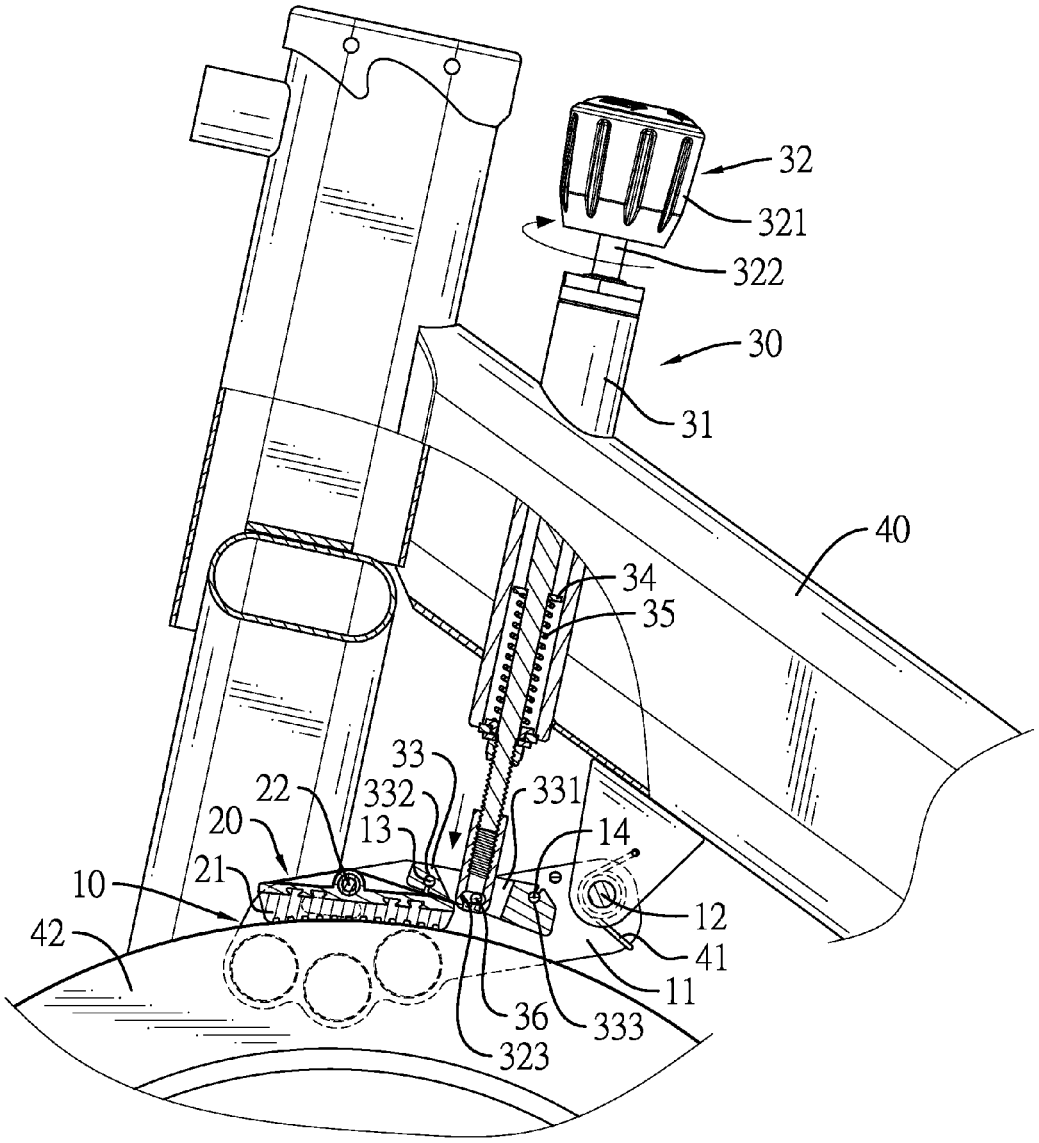
FIG. 5 is an operational side view in partial section of the resistance adjusting apparatus in FIG. 1, mounted on a frame of an exercise bike.

With reference to FIG. 5, in use, the regulating rod 32 is rotated by the users, and the pressing block 33 is driven by the regulating rod 32 to move upward or downward relative to the tube 31. The seat 10 driven by the pressing block 33 is pivoted, and the resistance supplier 20 follows the rotation of the seat 10 and is moved to form a displacement. The resistance element 21 is pressed by the front end of the pressing block 33 and is contacted with the flywheel 42 to provide a resistance to the flywheel 42.

The pressing block 33 is located between the first shaft 12 of the seat 10 and the second shaft 22 of the resistance supplier 20. A distance between the first shaft 12 and the second shaft 22 is longer than a distance between the first shaft 12 and the pressing block 33. The distance between the first shaft 12 of the seat 10 and the second shaft 22 of the resistance supplier 20 is longer than a distance between the first shaft 12 of the seat 10 and the stick 36 of the adjusting assembly 30. When the regulating rod 32 is moved upward or downward, the seat 10 driven by the regulating rod 32 is pivoted upon the first shaft 12, and the displacement of the resistance supplier 20 is longer than a displacement of the pressing block 33. A position of the resistance supplier 20 deviates from a position of the pressing block 33, and the effect of the resistance adjustment of the regulating rod 32 is magnified.

The resistance supplier 20 is mounted in the seat 10 close to a front end of the seat 10. In a change operation of the resistance supplier 20, the users can remove the second shaft 22 from the seat 10 directly, and then the resistance element 21 can be detached from the seat 10 without dissembling the side plates 11 of the seat 10. A new resistance element 21 is deposited between the two side plates 11 of the seat 10 and is fixed on the seat 10 via the second shaft 22.

Accordingly, the position of the resistance supplier 20 deviates from the position of the pressing block 33 that is mounted on the bottom end of the regulating rod 32. The sensitivity and the precision of the regulating rod 32 are promoted. In addition, the position of the resistance supplier 20 diverges from the position of the pressing block 33 mounted on the bottom end of the regulating rod 32. The resistance supplier 20 is mounted on the seat 10 individually without connecting to the regulating rod 32. Therefore, the resistance supplier 20 can be changed without dissembling the side plates 11 of the seat 10. The change operation of the resistance supplier 20 is convenient and the change time of the resistance supplier 20 is reduced.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "includes," "including," "having," "has", and "have," are inclusive and therefore specify the presence of stated features, elements, and/or components, but do not preclude the presence or addition of one or more other features, elements, components, and/or groups thereof.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A resistance adjusting apparatus comprising:

a seat having:

two side plates mounted in the seat and spaced apart from each other; and a first shaft mounted between the two side plates;

a resistance supplier mounted in the seat between the two side plates, the resistance supplier having:

a resistance element located between the two side plates and opposite to the first shaft; and a second shaft mounted on the seat and inserted through the resistance element, the second shaft having two ends respectively connected to the two side plates; and an adjusting assembly mounted on the seat, the adjusting assembly having:

a tube being hollow above the seat;

a regulating rod moveably mounted through the tube; and a pressing block mounted on a bottom end of the regulating rod and connected to the side plates, the pressing block located between the first shaft of the seat and the second shaft of the resistance supplier, the pressing block having a front end extending above a rear end of the resistance element.

2. The resistance adjusting apparatus as claimed in claim 1, wherein the regulating rod includes:

a body mounted in and extending out of the tube, and the pressing block mounted on a bottom end of the body; and a head mounted on a top end of the body above the tube.

3. The resistance adjusting apparatus as claimed in claim 2, wherein the adjusting assembly includes:

a barrier fixedly mounted around the body and located in the tube; and a compression spring mounted around the body, and two ends of the compression spring respectively connected to the barrier and the tube.

4. The resistance adjusting apparatus as claimed in claim 2, wherein:

the pressing block includes a top face, a bottom face, a side face, a recess formed through the top face and the bottom face of the pressing block, and a through hole formed through the side face of the pressing block and communicating with the recess;

the body includes an elongated hole formed through the bottom end of the body; and the adjusting assembly includes a stick mounted in the seat and inserted through the through hole of the pressing block, the elongated hole of the body, and the recess of the pressing block.

5. The resistance adjusting apparatus as claimed in claim 3, wherein:

the pressing block includes a top face, a bottom face, a side face, a recess formed through the top face and the bottom face of the pressing block, and a through hole formed on the side face of the pressing block and communicating with the recess;

the body includes an elongated hole formed through the bottom end of the body, and the adjusting assembly includes a stick mounted in the seat and inserted through the through hole of the pressing block, the elongated hole of the body, and the recess of the pressing block.

6. The resistance adjusting apparatus as claimed in claim 4, wherein the pressing block includes:

a first positioning hole formed in the bottom face of the pressing block adjacent to the front end of the pressing block; and a second positioning hole formed in the top face of the pressing block adjacent to a rear end of the pressing block; and the seat includes:

a first positioning rod mounted between the two side plates and inserted through the first positioning hole of the pressing block; and a second positioning rod mounted between the two side plates and inserted through the second positioning hole of the pressing block.

* * * * *